US007344053B2

(12) United States Patent
Sweeton

(10) Patent No.: US 7,344,053 B2
(45) Date of Patent: Mar. 18, 2008

(54) SUSTAINED DURATION NON-AEROSOL MECHANICAL SPRAYER HAVING A WINDOW FOR VIEWING THE CHARGED/UNCHARGED CONDITION OF A TRANSPARENT OR TRANSLUCENT ACCUMULATOR

(75) Inventor: Steve L. Sweeton, Lake Winnebago, MO (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 0 days.

(21) Appl. No.: 11/423,515

(22) Filed: Jun. 12, 2006

(65) Prior Publication Data

US 2006/0283895 A1 Dec. 21, 2006

Related U.S. Application Data

(60) Provisional application No. 60/690,774, filed on Jun. 15, 2005.

(51) Int. Cl.
*B67D 5/38* (2006.01)

(52) U.S. Cl. ..... 222/159; 222/383.1

(58) Field of Classification Search ..... 222/159, 222/383.1

See application file for complete search history.

(56) References Cited

U.S. PATENT DOCUMENTS

| | | | | |
|---|---|---|---|---|
| 665,914 | A | | 1/1901 | Kindermann |
| 1,671,779 | A | | 5/1928 | Pearsons |
| 1,676,358 | A | | 7/1928 | Schott |
| 1,681,845 | A | | 8/1928 | Dilley et al. |
| 1,929,564 | A | * | 10/1933 | Mair ..... 222/383.1 |
| 2,060,297 | A | | 11/1936 | Fox |
| 2,232,522 | A | | 2/1941 | Gray |
| 2,241,097 | A | | 5/1941 | Mezzapesa |
| 2,474,748 | A | | 6/1949 | McMurray |
| 2,545,319 | A | | 3/1951 | Sundholm |
| 3,002,699 | A | | 10/1961 | Pinke |
| 3,042,981 | A | | 7/1962 | Dilione |
| 3,092,330 | A | | 6/1963 | Ridenour et al. |
| 3,730,398 | A | | 5/1973 | Goda |
| 4,174,055 | A | | 11/1979 | Capra et al. |
| 4,192,464 | A | | 3/1980 | Chow |
| 4,196,828 | A | | 4/1980 | Basile et al. |
| 4,905,906 | A | | 3/1990 | Trefzger |
| 5,199,614 | A | | 4/1993 | Husman |
| 5,373,973 | A | | 12/1994 | Foster |
| 5,469,993 | A | | 11/1995 | Hauf et al. |
| 5,485,942 | A | | 1/1996 | Foster |
| 5,553,750 | A | | 9/1996 | Foster |
| 5,601,211 | A | | 2/1997 | Foster |

(Continued)

*Primary Examiner*—Philippe Derakshani
(74) *Attorney, Agent, or Firm*—Gordon & Jacobson, PC

(57) ABSTRACT

A sustained duration non-aerosol mechanical sprayer includes a spray head which is screwed onto the top of a bottle. The spray head includes a spring biased piston in a cylinder, a lever which is coupled to the piston via a flexible cable. A thumb support is provided to facilitate movement of the lever. A load bearing surface is provided to absorb force exerted by moving the lever. Anti-rotation structure is provided to locate the spray head relative to the bottle. A window in the spray head allows the contents of the cylinder to be viewed. According to some embodiments, the nozzle is located at one end of the spray head and the end of the accumulator to which the inlet and outlet are connected is located at an opposite end of the spray head.

8 Claims, 17 Drawing Sheets

U.S. PATENT DOCUMENTS

| | | | |
|---|---|---|---|
| 5,609,272 | A | 3/1997 | Brass et al. |
| 5,649,664 | A | 7/1997 | Brass et al. |
| 5,651,908 | A | 7/1997 | Mansfield |
| 5,722,566 | A | 3/1998 | Glynn |
| 5,810,211 | A | 9/1998 | Shanklin et al. |
| 5,816,447 | A | 10/1998 | Shanklin et al. |
| D402,205 | S | 12/1998 | Shanklin et al. |
| 5,860,574 | A | 1/1999 | Shanklin et al. |
| D407,312 | S | 3/1999 | Shanklin et al. |
| 5,918,782 | A | 7/1999 | Shanklin et al. |
| 5,938,116 | A | 8/1999 | Restive et al. |
| 6,089,414 | A | 7/2000 | Shanklin et al. |
| 6,170,706 | B1 | 1/2001 | Havlovitz |
| 6,296,154 | B1 | 10/2001 | Shanklin et al. |
| 6,360,922 | B1 | 3/2002 | Englhard |
| 6,415,956 | B1 | 7/2002 | Havlovitz |

* cited by examiner

SUSTAINED DURATION NON-AEROSOL MECHANICAL SPRAYER HAVING A WINDOW FOR VIEWING THE CHARGED/UNCHARGED CONDITION OF A TRANSPARENT OR TRANSLUCENT ACCUMULATOR

CROSS-REFERENCE TO RELATED APPLICATIONS

This application claims benefits from U.S. Provisional Patent Application No. 60/690,774, filed Jun. 15, 2005, the contents of which are hereby incorporated herein by reference.

BACKGROUND OF THE INVENTION

1. Field of the Invention

This invention relates broadly to non-aerosol sprayers. More particularly, this invention relates to a sustained duration mechanical sprayer.

2. State of the Art

Many household and industrial products are sold in containers that include a sprayer. These products include cleansers, insecticides, polishes, waxes, etc. There are several kinds of sprayers used with these products. Perhaps the most common is the manual push button or trigger operated pump which is seen most frequently on liquid cleansers. It has the advantage of being environmentally friendly (i.e. it does not require a propellant) but the disadvantage of delivering fluid in a series of pulses rather than in a continuous spray. Another well known sprayer is the aerosol can which is sealed and charged with a gas propellant. This sprayer has the advantage that it dispenses fluid in a continuous spray, but has several disadvantages. One disadvantage is that the can cannot be refilled. Another disadvantage is that depending on the gas used to charge the container, the propellant can be environmentally unfriendly. While environmentally friendly propellants do exist, generally, they do not charge as well as the unfriendly gases. Still another popular sprayer is the air pump sprayer seen most frequently with insecticides and liquid garden products. See, for example, U.S. Pat. No. 4,192,464 to Chow. The pump sprayer includes a hand operated air pump which is used to charge the container with compressed air. After it is charged, it operates much like an aerosol can except that the spray head is typically attached to the container by a hose and the container is supplied with a carrying handle. The design permits a gardener to charge the pump while it is on the ground, then carry it in one hand with the handle while the other hand operates the sprayer. The air pump sprayer is environmentally friendly but requires considerable effort to keep charged because air is not as efficient a propellant as environmentally unfriendly gases such as FREON or hydrocarbon gasses. Charging requires that the container be placed on the ground while the gardener pumps the air pump.

Still another type of sprayer is the spring biased sustained duration pump. An example of such a pump is shown in U.S. Pat. No. 5,810,211 to Shanklin et al. Like the air pump described above, these sprayers are typically used for garden products such as insecticides, herbicides, etc. The pump is mounted inside the fluid container and is coupled to a hand held sprayer by a hose (flexible tube). The container is provided with a handle and the pump is primed while holding the container on the ground or on a surface like a table top. The spring biased pump does not utilize air to propel liquid from the container through the nozzle. Rather, a spring biased piston is provided inside a cylinder and connected to a rod which extends through the spring, out of the cylinder and out of the container terminating with a handle. A one-way inlet valve is coupled to the cylinder and the tube from the spray head is coupled to the cylinder via a one-way outlet valve. When the handle is pulled, the piston is moved through the cylinder against the spring, drawing liquid from the container into the cylinder via the one-way inlet valve. When the handle is let go, the spring exerts force against the piston which pressurizes the liquid in the cylinder. The only outlet for the liquid is through the one-way outlet valve into the tube to the spray head which has a spray valve to control dispensing of the liquid. When the spray valve is opened by pushing a button on the hand held sprayer, liquid under pressure flows from the cylinder through the tube to the spray valve, through the spray valve and out a nozzle on the hand held sprayer. The duration of the spray depends on the volume of the cylinder, the force of the spring, and the size/shape of the nozzle. When the spring returns the piston to the starting position, the sustained continuous spray ceases and the pump must be primed again. The amount of liquid in the cylinder can be gauged by the length of the rod extending out of the container.

The spring biased sustained duration pump has many advantages. It is environmentally friendly. It is relatively easy to operate and it is potentially more efficient than the air pump sprayer. However, these sprayers also have some disadvantages. The fact that the container must be held down with one hand while the pump is primed with the other hand is a disadvantage. The fact that the pump cylinder occupies space inside the fluid container is another disadvantage. It is also a disadvantage that the piston rod extends out of the liquid container when the pump is primed. This projecting rod is awkward and can get in the way or get caught on something as the sprayer and container are carried about in use.

Some of the aforementioned disadvantages have been addressed in U.S. Pat. No. 6,415,956 to Havlovitz which proposes locating the spring biased piston and cylinder in the hand held sprayer. However, this does not cure the awkwardness of the piston rod extending into space where it can get in the way or get caught on something. Moreover, in order to accommodate the pump in the hand held sprayer, a rather complex spray valve arrangement is required.

SUMMARY OF THE INVENTION

It is therefore an object of the invention to provide a sustained duration non-aerosol mechanical sprayer.

It is another object of the invention to provide a sustained duration non-aerosol mechanical sprayer which is not contained in a fluid container.

It is a further object of the invention to provide a sustained duration non-aerosol mechanical sprayer which can be primed without placing the container on a surface.

It is also an object of the invention to provide a sustained duration non-aerosol mechanical sprayer which does not have a piston rod which extends from the sprayer when it is primed.

It is an additional object of the invention to provide a sustained duration non-aerosol mechanical sprayer which has a simple spray valve arrangement.

In accord with these objects, which will be discussed in detail below, a sustained duration non-aerosol mechanical sprayer includes a spray head which is screwed onto the top of a bottle to form an integral unit (i.e. not a sprayer coupled to a container by a flexible tube). The spray head includes a spring biased piston in a cylinder (also referred to as an accumulator), a lever charging element which is coupled to the piston via a flexible cable, an inlet check valve between an inlet to the accumulator and the bottle, an outlet tube located on the same side of the piston as the inlet, a nozzle, an outlet valve located in the fluid path between the outlet and the nozzle, and a trigger mechanism which actuates the outlet valve.

According to some embodiments of the invention, the nozzle is located at one end of the spray head and the end of the accumulator to which the inlet and outlet are connected is located at an opposite end of the spray head. Thus, the piston must be moved towards the nozzle to prime the pump and the piston moves away from the nozzle during spraying.

The lever is mounted on the exterior of the spray head and is movable from the front (nozzle end) of the spray head to the rear end of the spray head to charge the pump. A series of pulleys are arranged to guide the flexible cable from the piston to the lever. In this arrangement (which is opposite to what is shown in the prior art), a tube must be provided to couple the outlet of the cylinder at the back of the spray head to the front where the nozzle is located. However, the benefit of this arrangement is that the valve and trigger arrangement can be made simpler. According to alternate embodiments, the accumulator is arranged with its inlet and outlet adjacent to the nozzle. In one embodiment, the outlet valve is integral with the accumulator.

According to the presently preferred embodiment, a load bearing surface supporting a vertical force component sustained when the accumulator is charged is located behind the coupling between the bottle and the spray head. The load bearing surface may be part of the bottle or part of the spray head or both. It may be provided with an anti-rotation detent or a bayonet lock. The load bearing surface relieves stress on the bottle neck and coupling when the lever is pulled back to charge the pump.

Optionally, a thumb support/grip is provided on the top of the spray head. The thumb support/grip allows the user to gain leverage when charging the pump by placing the thumb behind the rest/grip while pulling the charging lever with the fingers.

According to another preferred aspect of the invention, the accumulator is clear and a window is provided on at least one side of the spray head whereby the contents of the accumulator may be viewed. This allows a ready assessment of whether the pump needs to be charged.

According to the most recently preferred embodiment, the accumulator is arranged substantially perpendicular to the vertical axis of the bottle and the inlet and outlet are adjacent the nozzle.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
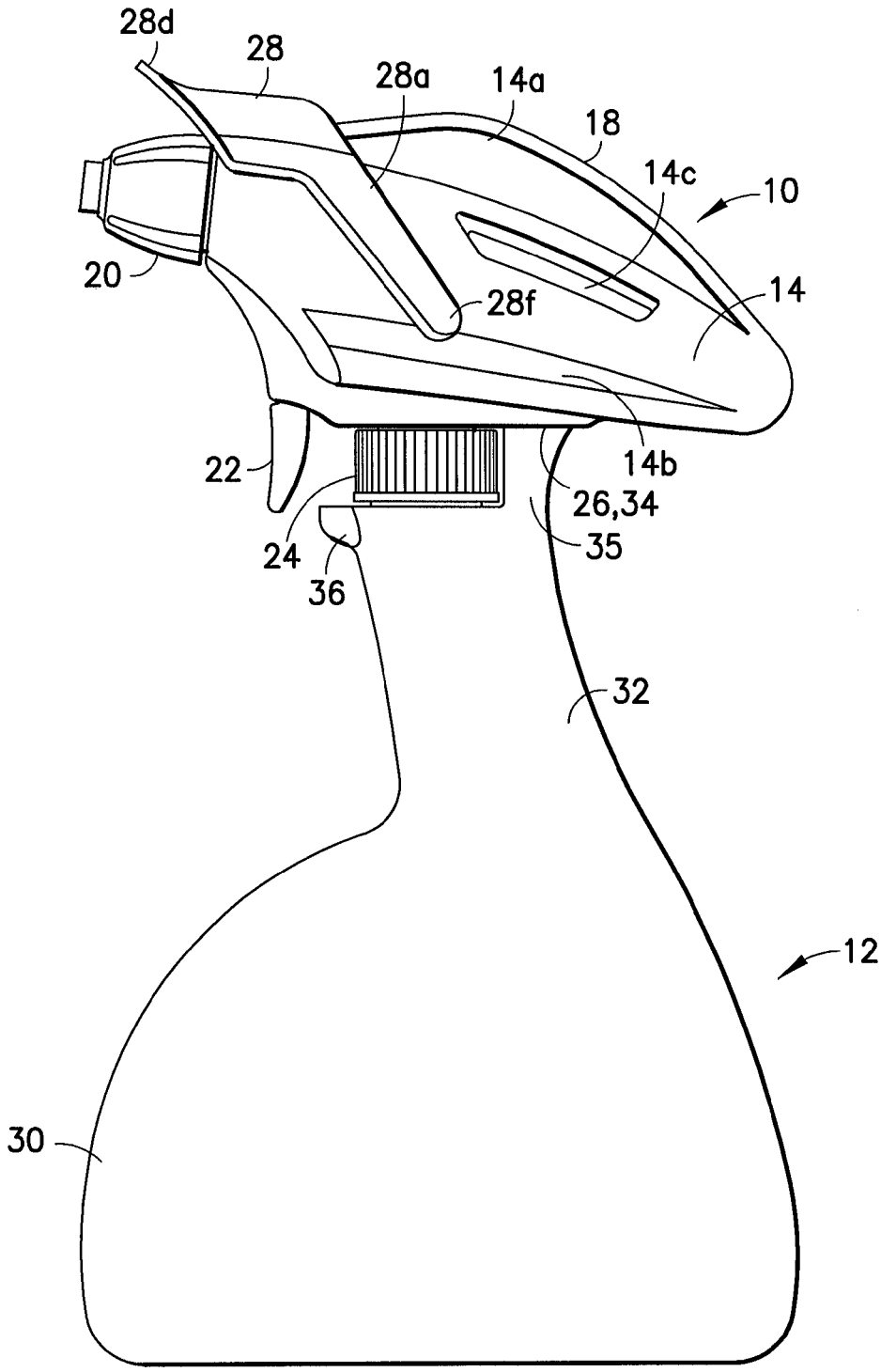
FIG. 1 is a side elevation view of a first embodiment of a sprayer according to the invention attached to a bottle according to the invention.

FIGS. 1-6 illustrate a first embodiment of a sprayer 10 and a bottle 12. The sprayer 10 generally includes an ellipsoidal body having left and right half shells 14, 16. Each half shell has an upper vane 14*a*, 16*a* and a lower wing 14*b*, 16*b*. At least one of the half shells, e.g. 14 has a side window 14*c*. The two vanes 14*a*, 16*a* join to define a groove 18 which extends from the front of the body to a point short of the rear as seen best in FIG. 3. The front of the body is provided with an adjustable nozzle 20 and the bottom of the body is provided with a trigger 22, a bottle coupling 24, and a load bearing surface 26. A pull lever 28 is mounted above the wings 14*b*, 16*b*. The lever 28 is a generally inverted U-shape having two legs 28*a*, 28*b* and a cross member 28*c*. The cross member 28*c* defines an upwardly extending handle 28*d* and a downwardly extending rudder 28*e* (FIG. 3) which engages and rides in the groove 18. The ends of the legs 28*a*, 28*b* have lugs or bosses 28*f*, 28*g* (FIG. 4) extending inward therefrom. These lugs or bosses engage holes 14*d*, 16*d* in the left and right half shells 14, 16 and define the pivot axis of the lever 28. The pivot axis is preferably aligned close to or on the vertical axis of the bottle coupling 24.

The bottle 12 has a lower tank area 30 and an upper neck 32 which is dimensioned to be grasped by an adult human hand. The neck 32 has a threaded coupling which is hidden under the coupling 24 of the sprayer 10. Behind the coupling the bottle has a load bearing surface 34 which abuts the load bearing surface 26 on the sprayer 10. As illustrated, the load bearing surface 34 is a plateau on a stem 35 which rises behind the coupling 24 to abut a planar surface 26 on the sprayer. The stem 35 and the load bearing surface 34 are preferably generally semi-circular and have a thickness sufficient to support a vertical load during backward movement of the lever 28. It will be appreciated, however, that the load bearing surface of the sprayer could be at the bottom of a downward extension and the load bearing surface on the bottle could be a planar surface below it. Another feature of the bottle 12 is a finger rest 36 located below and between the trigger 22 and the coupling 24 of the sprayer. In use the user grasps the neck 32 with middle finger, ring finger and pinky while using the index finger to pull the trigger. The finger rest 36 prevents the user's middle finger from riding up the neck 32 into the path of the trigger 22.

From the foregoing and the following, those skilled in the art will appreciate that the load bearing surface arrangements of the invention may be useful in other sprayers where the charging element exerts a force on the bottle with a vertical load component during charging. This clearly applies to most levers and may apply to other charging elements Turning now to FIGS. 4-6, the inner workings of the sprayer 10 are shown in detail. The sprayer includes an accumulator 40 (a piston cylinder), a piston 42, a piston retainer 44, a biasing spring 46, an accumulator cap 48, and a pull cable 50. These components are assembled by extending the pull cable 50 through the cap 48 and the spring 46 to the retainer 44. One end of the cable 50 is attached to the retainer 44 which is coupled to the piston 42. The piston 42 is inserted into the accumulator 40 with the retainer 44 and the cable 50 following it. The spring 46 is inserted into the accumulator 40 behind the retainer 44 and the accumulator is closed by the cap 48. The free end of the cable 50 extends through the cap 48 and is attached to the pull lever 28. At the end of the accumulator opposite the cap 48 is a fluid inlet/outlet 52 (seen best in FIGS. 5 and 6) to which a manifold 54 is attached. Two hoses 56, 58 are coupled to the manifold 54 as seen best in FIG. 6. Inlet hose 56 is also coupled to a ball check manifold 60 which includes a plastic ball 62 and a ball check fitting which operate in conjunction to form a one-way valve which is coupled to an intake tube (not shown) that extends down into the fluid in the bottle. Liquid hose 58 is coupled to the inlet of one cylinder 66*a* (liquid valve) of a double valve body 66. Two additional hoses 68 and 70 are provided. Vent hose 68 couples the inlet of the second cylinder 66*b* (air valve) of the double valve body 66 and extends into the interior of the bottle via the manifold 60. Liquid hose 70 couples the outlet of cylinder 66*a* to a nozzle adapter 72 which is coupled to the nozzle 20. Each of the cylinders 66*a*, 66*b* of the double valve body is provided respectively with a spring 74*a*, 74*b*, a flared piston 76*a*, 76*b*, and a piston cap 78*a*, 78*b*, the latter of which are engaged by the trigger 22. In the resting state the springs 74*a*, 74*b* bias the pistons to a position where the flares on the pistons block fluid flow through the cylinders 66*a* and 66*b*. When actuated by the trigger 22, the flares of the pistons are moved into larger portions of the cylinders, thereby permitting fluid flow through the cylinders.

From the foregoing, those skilled in the art will appreciate how the sprayer works, namely as follows. The spray pump is charged by moving the pull handle 28 (about its pivot axis) from the front of the sprayer toward the rear. This causes the cable 50 to be pulled out of the accumulator 40 pulling the piston 42 against the spring 46 away from the fluid inlet/outlet 52, and causing a vacuum within the accumulator 40 and the hoses 56 and 58. Since the hose 56 is coupled to the one way valve assembly 60, 62, 64, it causes the ball 62 to rise, opening the valve and allowing fluid to enter the hose 56 from the bottle into the accumulator 40. The vacuum in hose 56 does nothing because the end of hose 56 is blocked by the flared piston in the valve cylinder 66*a*. When the handle 28 is released or moved as far back as it can go (limited by the length of the cable 50 as well as the length of the groove 18) and released, the spring 46 will exert a force against the piston 42 in the accumulator 40 compressing the fluid therein as well as the fluid in the hose 56 which causes the ball 62 to drop, sealing off the fluid path into the bottle. Fluid from the accumulator 40 will be fed under pressure through the manifold 54 into the hose 58 but goes no further because of the piston blocking the cylinder 66*a*. When the trigger 22 is squeezed, the piston in the cylinder 66*a* is moved, allowing fluid flow therethrough. Fluid under pressure in the accumulator moves through the hose 58 through the cylinder 66*a*, through the hose 70, into the nozzle adapter 72 and out through the nozzle 20. As fluid is ejected from the accumulator, the spring urges the piston towards the manifold until all of the fluid is expelled from the accumulator and the spring and the pull handle move toward their original position. When the sprayer is spraying, the piston in cylinder 66*b* is moved allowing air to enter the bottle and replace the fluid which was previously drawn into the accumulator.

Figure 4:
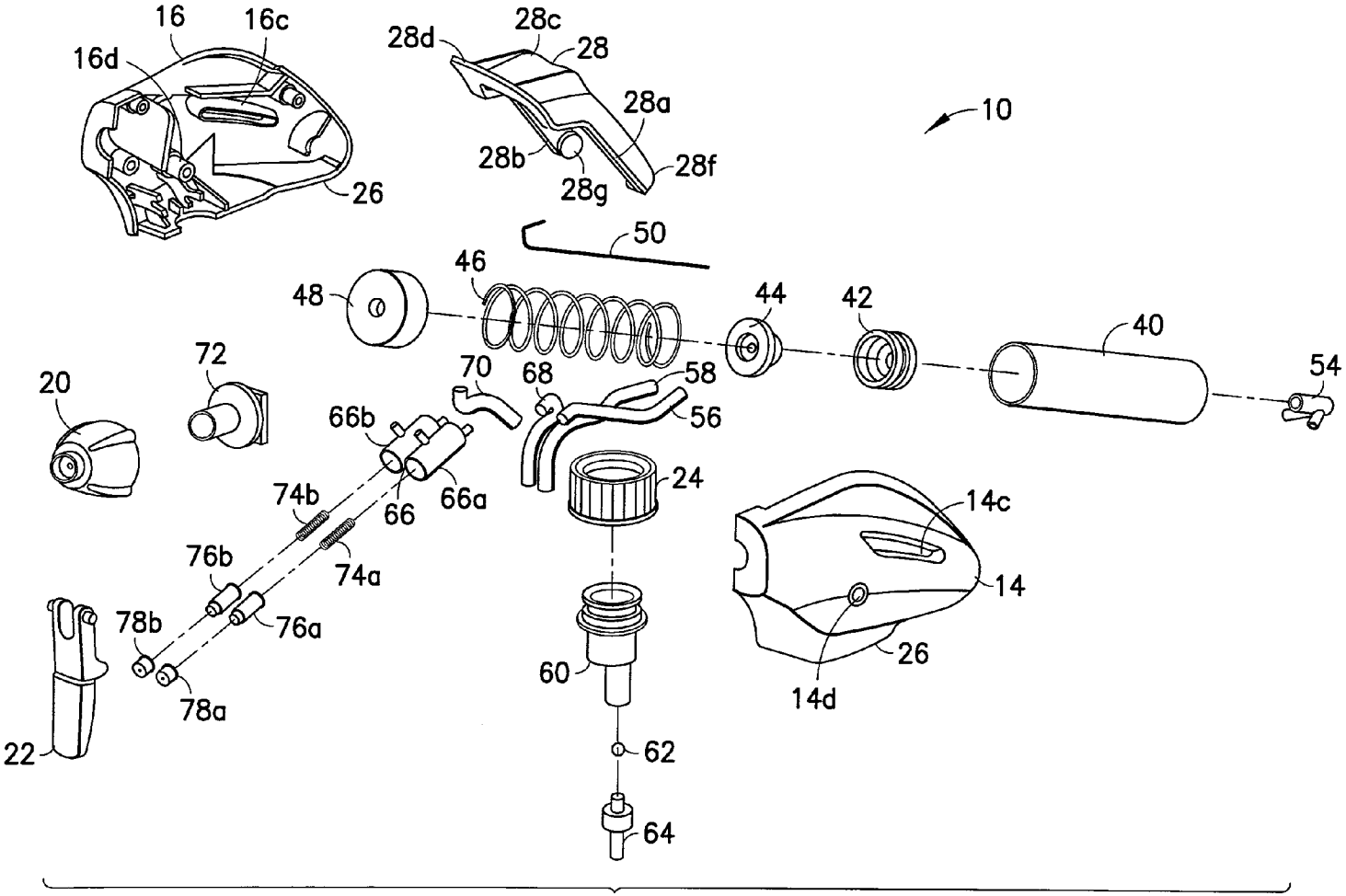
FIG. 4 is an exploded view of the sprayer of FIG. 1.
Figure 5:
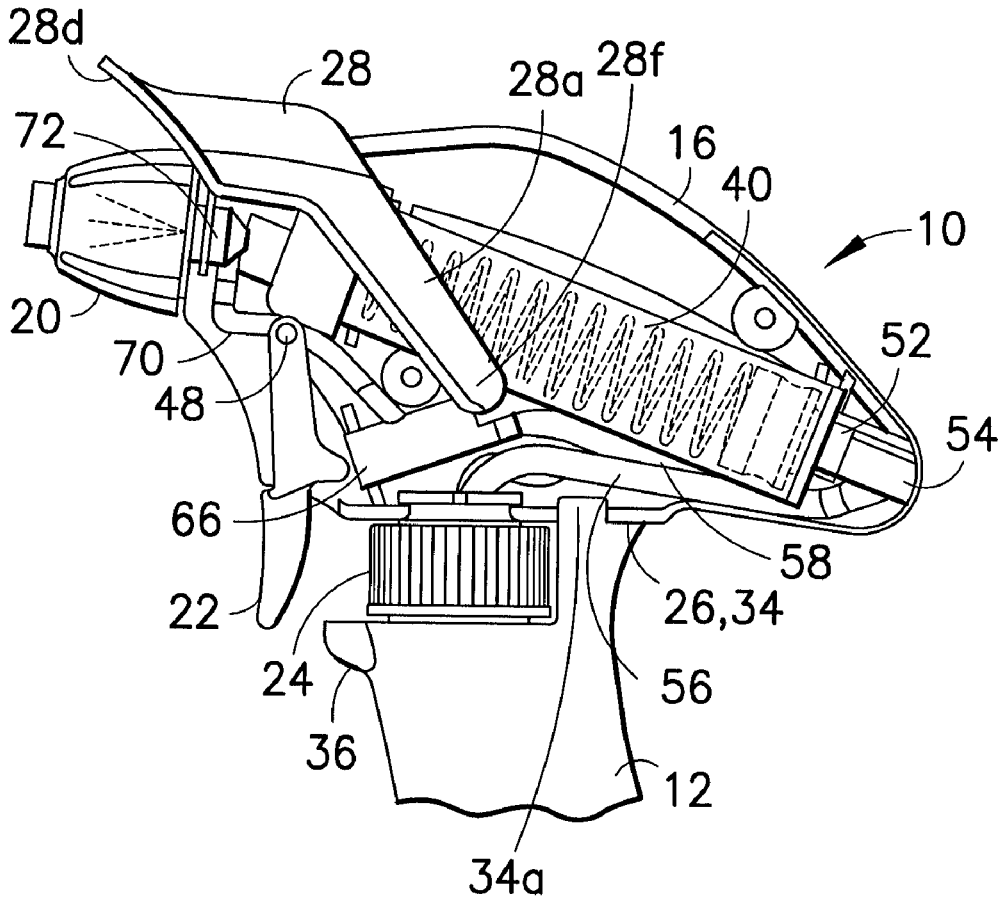
FIG. 5 is a partially disassembled broken side elevation view of the left side of the sprayer and bottle of FIG. 1.
Figure 6:
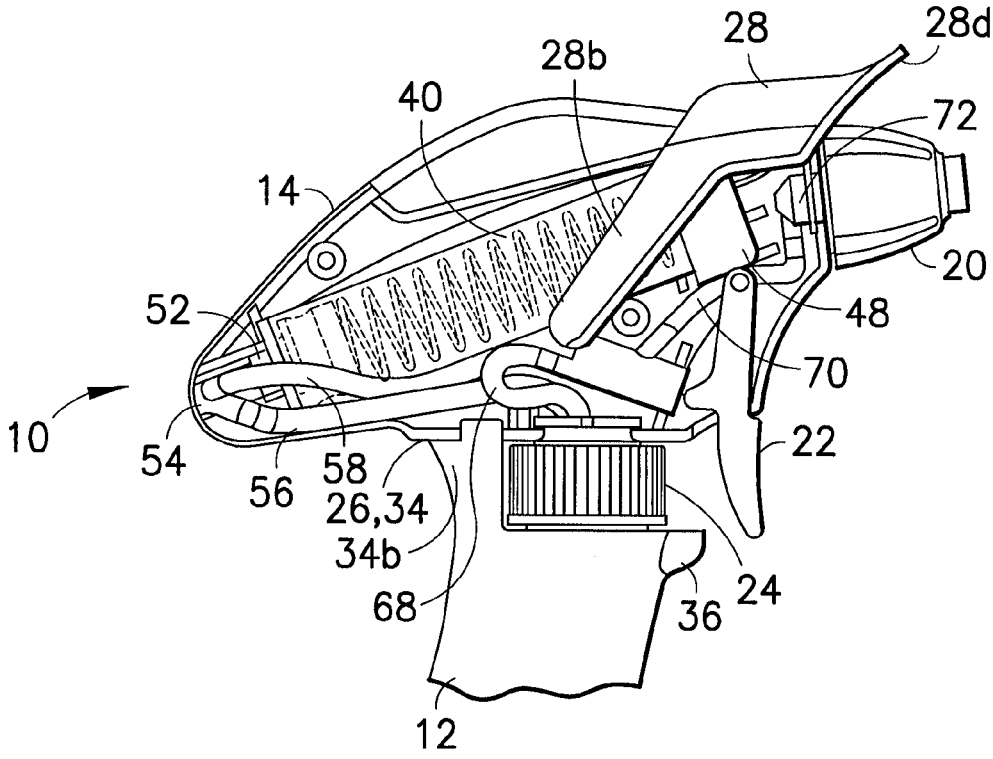
FIG. 6 is a partially disassembled broken side elevation view of the right side of the sprayer and bottle of FIG. 1.

As seen best in FIGS. 5 and 6, the accumulator 40 is clear and as seen best in FIG. 4, both the half shells 14 and 16 are provided with windows 14*c*, 16*c*. The windows allow viewing of the contents of the accumulator. Also, it will be noted that in the illustrated embodiment, the load bearing surfaces 26, 34 are accompanied by anti-rotation flanges 34*a*, 34*b* on the bottle. It will be appreciated that the load bearing surfaces relieve strain on the coupling 24 when the handle 28 is pulled back and that the anti-rotation flanges align the load bearing surfaces as well as align the trigger 22 with the finger rest 36.

Figure 7:
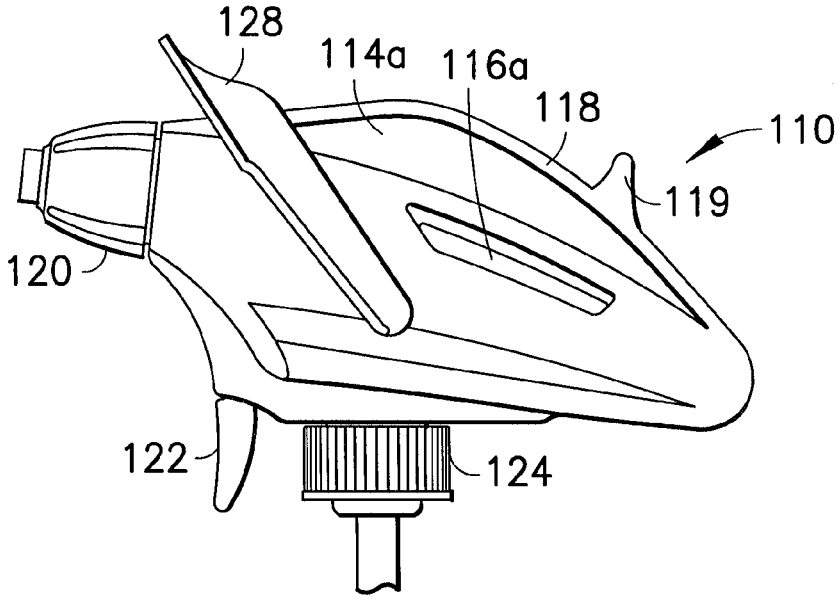
FIG. 7 is a broken side elevation view of a second embodiment of a sprayer according to the invention

Referring now to FIG. 7, a second embodiment of a sprayer 110 is substantially the same as the sprayer 10 described above with similar reference numerals (increased by 100) referring to similar parts. According to this embodiment, a thumb support 119 is formed by extensions of the fin portions 114*a*, 116*a*. The thumb support is located at the end of the groove 118. When charging the sprayer, the user places his/her thumb behind the thumb support 116, grabs the lever with their fingers, and pulls back on the lever using the thumb support for leverage. If the sprayer is charged this way, reduced stress is placed on the coupling 124.

Figure 2:
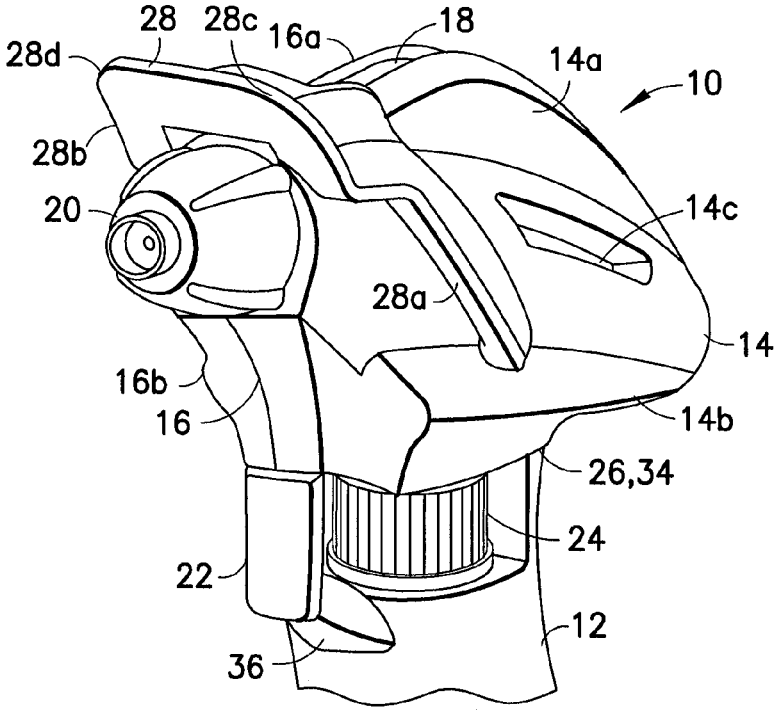
FIG. 2 is a broken perspective view of the front of the sprayer and bottle of FIG. 1.
Figure 3:
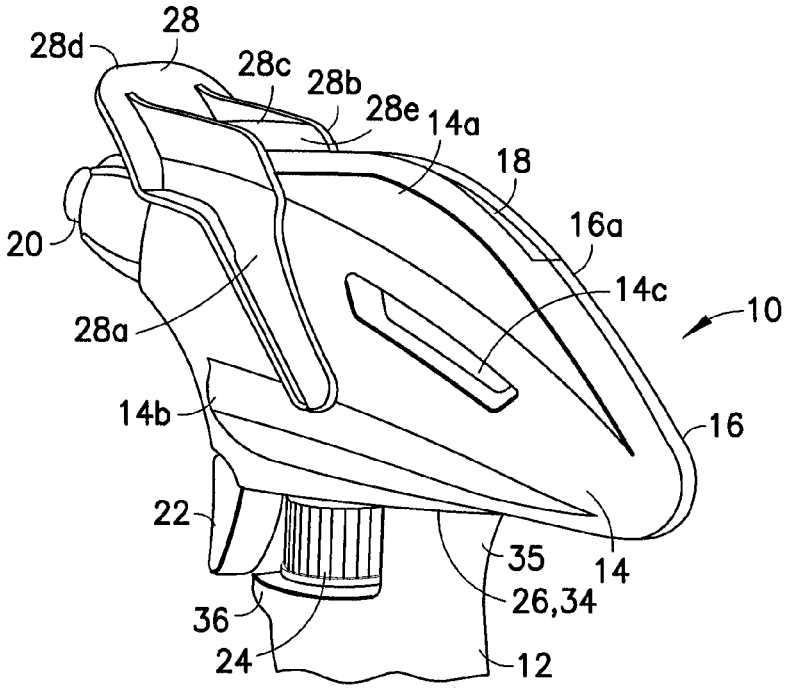
FIG. 3 is a broken perspective view of the rear of the sprayer and bottle of FIG. 1.
Figure 8:
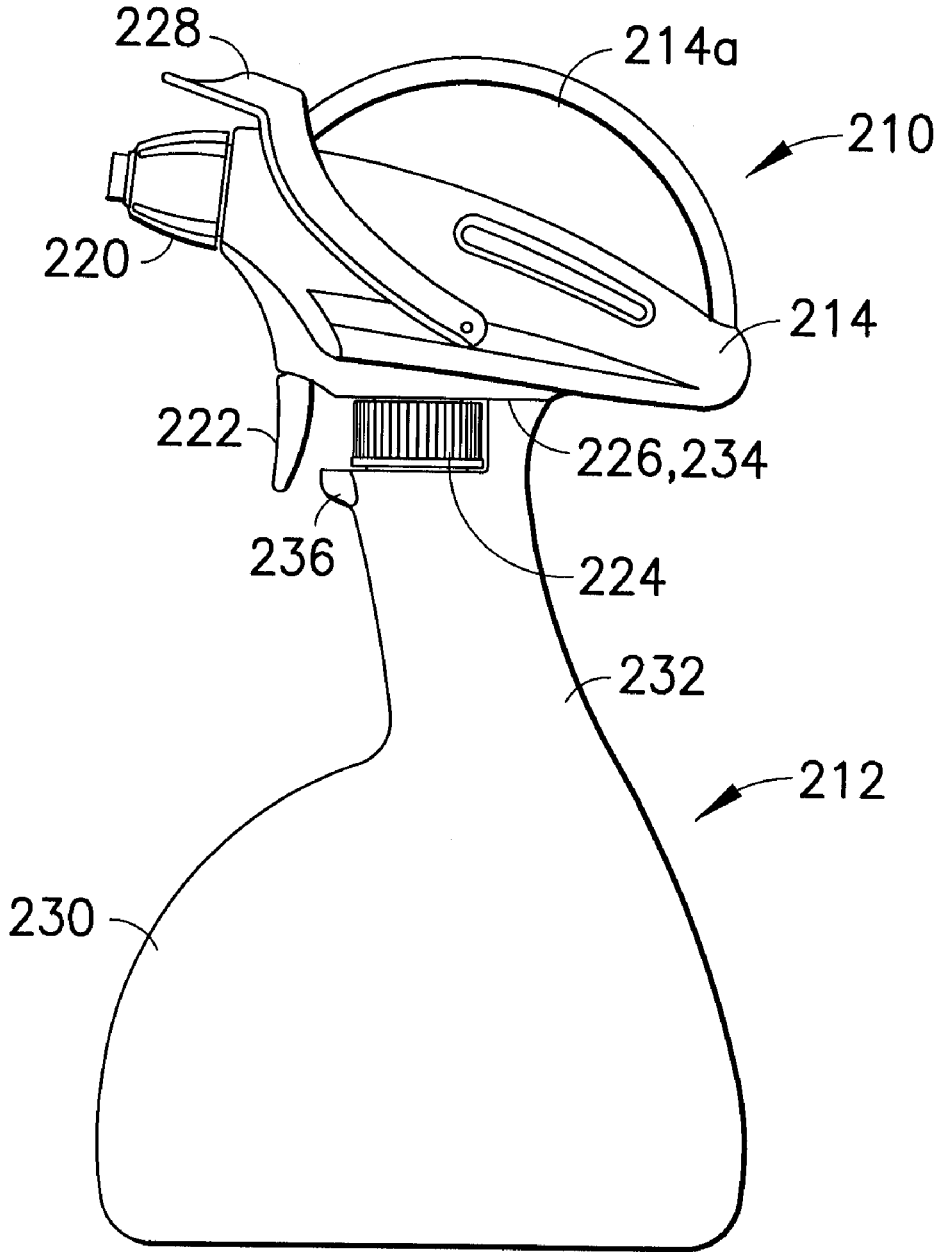
FIG. 8 is a side elevation view of a third embodiment of a sprayer according to the invention attached to a bottle according to the invention.
Figure 9:
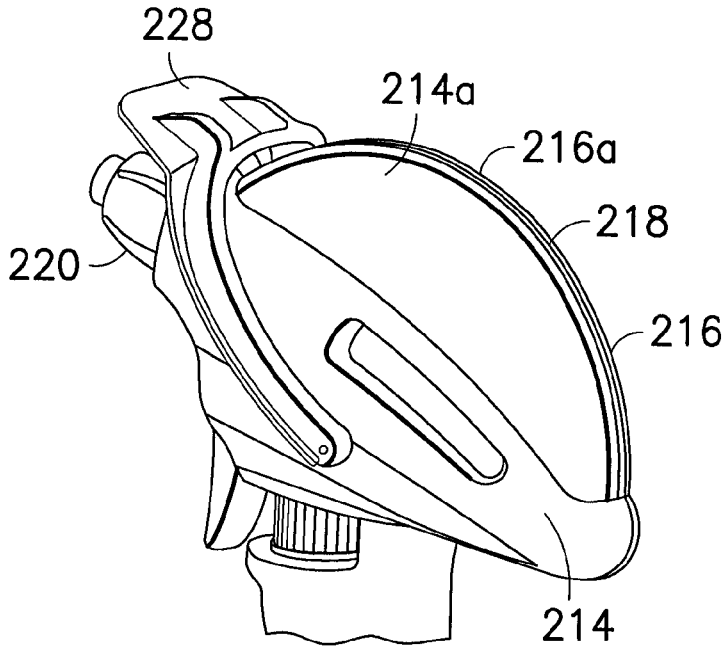
FIG. 9 is a broken perspective view of the rear of the sprayer and bottle of FIG. 8.
Figure 10:
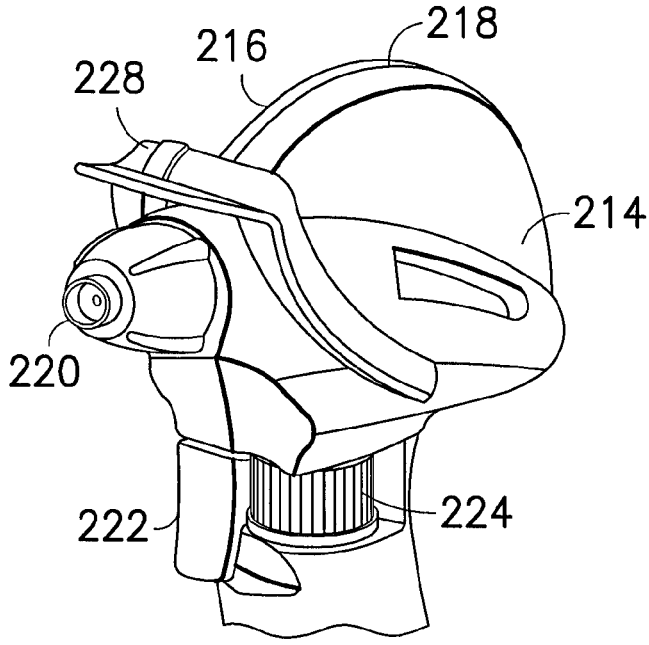
FIG. 10 is a broken perspective view of the front of the sprayer and bottle of FIG. 8.

FIGS. 8-10 are similar to FIGS. 1-3 with similar reference numerals (increased by 200) referring to similar parts. On the exterior, the sprayer 210 is similar to the sprayer 10 and the bottles 12 and 212 are identical. The only apparent difference in the appearance of the sprayers 10 and 210 is the size and shape of the fins 214*a*, 216*a* as compared to the fins 14*a*, 16*a* and also the shape of the lever 228 as compared to the lever 28.

Figure 11:
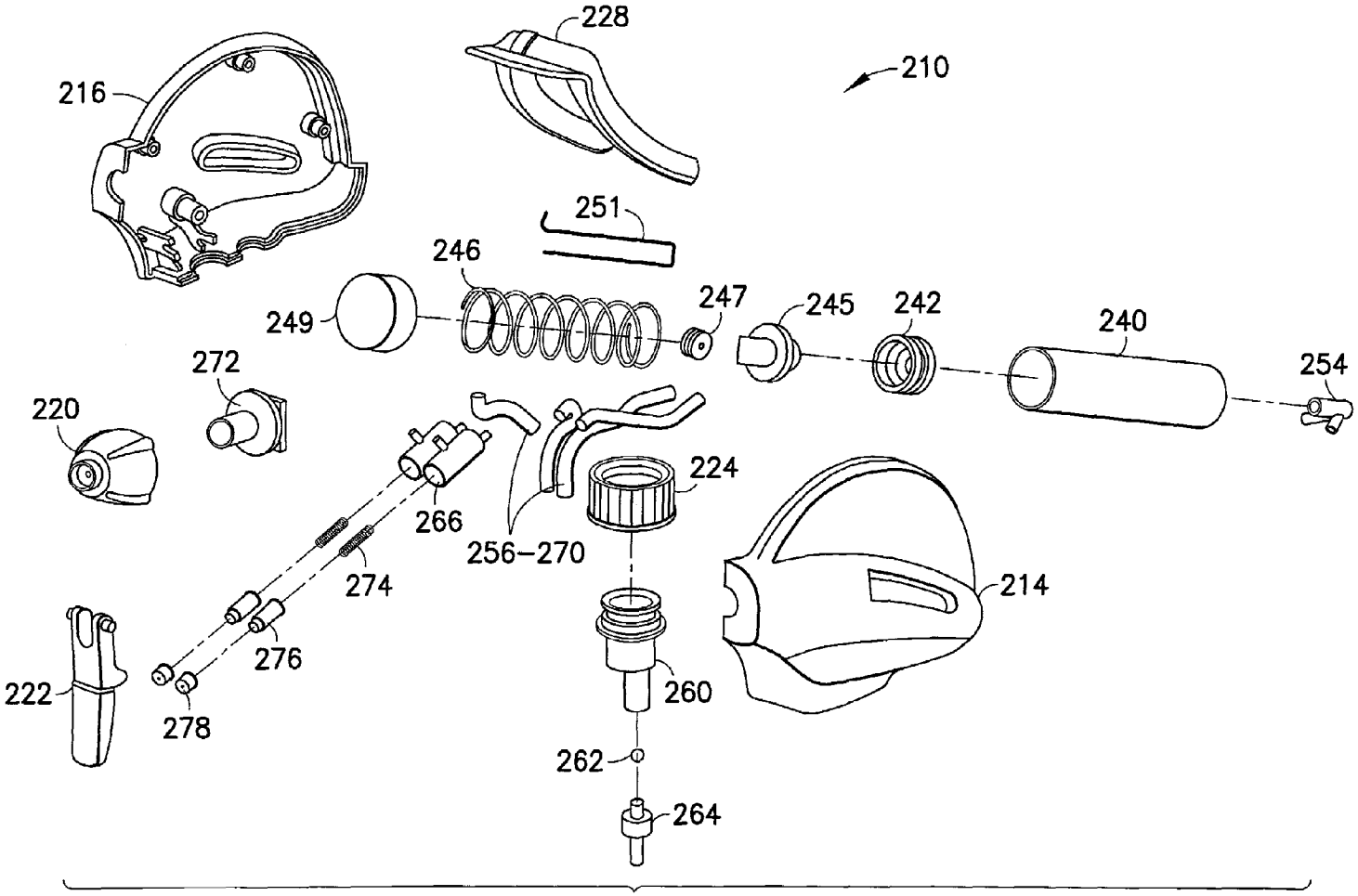
FIG. 11 is an exploded view of the sprayer of FIG. 8.
Figure 12:
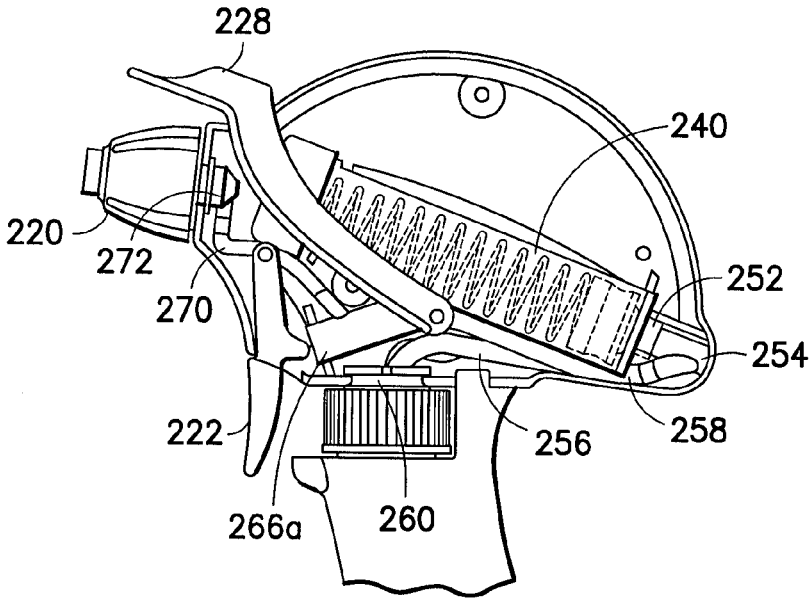
FIG. 12 is a partially disassembled broken side elevation view of the left side of the sprayer and bottle of FIG. 8.
Figure 13:
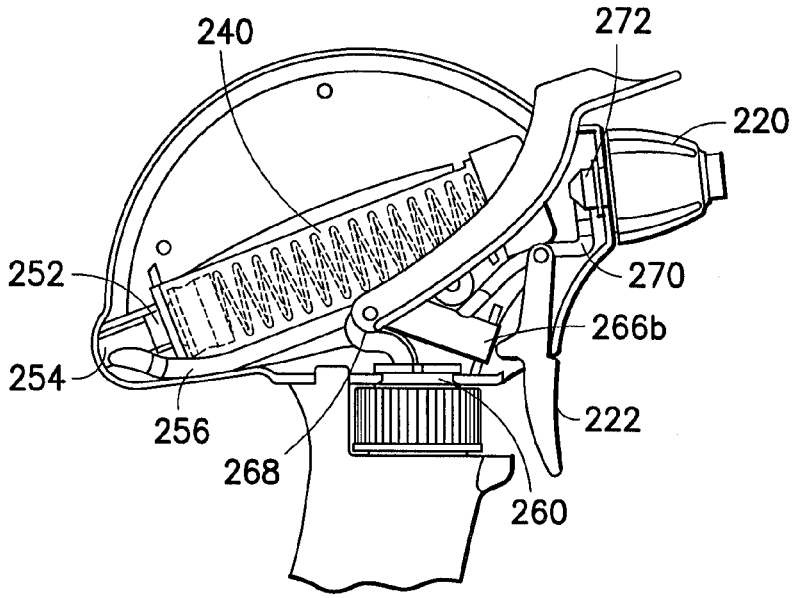
FIG. 13 is a partially disassembled broken side elevation view of the right side of the sprayer and bottle of FIG. 8.

FIGS. 11-13 illustrate the similarities and the differences between the sprayer 210 and the sprayer 10 shown in FIGS. 4-6. Similar reference numerals (increased by 200) refer to similar parts. Where there has been a significant departure in the design, dissimilar reference numerals have been used.

The sprayer 210 includes an accumulator 240 (a piston cylinder), a piston 242, a piston retainer 245, a pulley 247, a biasing spring 246, an accumulator cap 249, and a pull cable 251. The piston retainer 245 is different from the piston retainer 44 shown in FIG. 4 in that it is adapted to carry the pulley 247. As will be described in more detail in the next paragraph, the accumulator cap 249 and the pull cable 251 are different from the cap 48 and cable 50 shown in FIG. 4.

These components are assembled by extending one end of the pull cable 251 through the cap 249 and through the spring 246 around the pulley 247, back through the spring 246 and fastening it to the cap 249. The other end of the cable 251 extends through an opening in the cap 249 and is coupled to the lever 228. The piston 242 is inserted into the accumulator 240 with the retainer 245, pulley 247 and the cable 251 following it. The spring 246 is inserted into the accumulator 240 behind the retainer 245 and the accumulator is closed by the cap 249.

As seen best in FIGS. 12 and 13, the end of the accumulator opposite the cap 249 is a fluid inlet/outlet 252 to which a manifold 254 is attached. Two hoses 256, 258 are coupled to the manifold 254. Inlet hose 256 is also coupled to a ball check manifold 260 (FIG. 11) which includes a plastic ball 262 and a ball check fitting 264 which operate in conjunction to form a one-way valve which is coupled to an intake tube (not shown) that extends down into the fluid in the bottle. Outlet hose 258 is coupled to the inlet of one cylinder 266*a* (liquid valve) of the double valve body 266. Two additional hoses 268 and 270 are provided. Vent hose 268 couples the inlet of the second cylinder 266*b* (air valve) of the double valve body 266 and extends into the interior of the bottle via the manifold 260. Liquid hose 270 couples the outlet of the first cylinder 266*a* (liquid valve) of the double valve body to a nozzle adapter 272 which is coupled to the nozzle 220. As seen best in FIG. 11, each of the cylinders 266*a*, 266*b* of the double valve body is provided respectively with a spring 274, a flared piston 276, and a piston cap 278, the latter of which are engaged by the trigger 222. In the resting state the springs 274 bias the flared pistons to a position where the flares on the pistons block fluid flow through the cylinders 266*a*, 266*b*. When actuated by the trigger 222, the flares on the pistons are moved into larger portions of the cylinders, thereby permitting fluid flow through the cylinders.

From the foregoing, those skilled in the art will appreciate how the sprayer works, namely as follows. The spray pump is charged by moving the pull handle 228 from the front of the sprayer toward the rear, rotating it about its pivot axis. This causes the cable 251 to be pulled out of the accumulator 240 rotating over the pulley 247 pulling the piston 242 against the spring 246 away from the fluid inlet/outlet 252, and causing a vacuum within the accumulator 240 and the hoses 256 and 258. Since the hose 256 is coupled to the one way valve assembly 260, 262, 264, it causes the ball 262 to rise, opening the valve and allowing fluid to enter the hose 256 from the bottle into the accumulator 240. The vacuum in hose 256 does nothing because the end of hose 256 is blocked by the flared piston in the valve cylinder 266*a*. When the handle 228 is released or moved as far back as it can go (limited by the length of the cable 250 as well as the length of the groove 218) and released, the spring 246 will exert force against the piston 242 in the accumulator 240 compressing the fluid therein as well as the fluid in the hose 256 which causes the ball 262 to drop, sealing off the fluid path into the bottle. Fluid from the accumulator 240 will be fed under pressure through the manifold 254 into the hose 258 but goes no further because of the piston blocking the cylinder 266*a*. When the trigger 222 is squeezed, the piston in the cylinder 266*a* is moved, allowing fluid flow therethrough. Fluid under pressure in the accumulator moves through the hose 258 through the cylinder 266*a*, through the hose 270, into the nozzle adapter 272 and out through the nozzle 220. As fluid is ejected from the accumulator, the spring urges the piston towards the manifold until all of the fluid is expelled from the accumulator and the spring and the pull handle assume their original position or until the trigger is released.

Those skilled in the art will appreciate that this embodiment provides a mechanical advantage by way of the pulley 247. Thus, the force needed to charge the pump is lessened.

Figure 14:
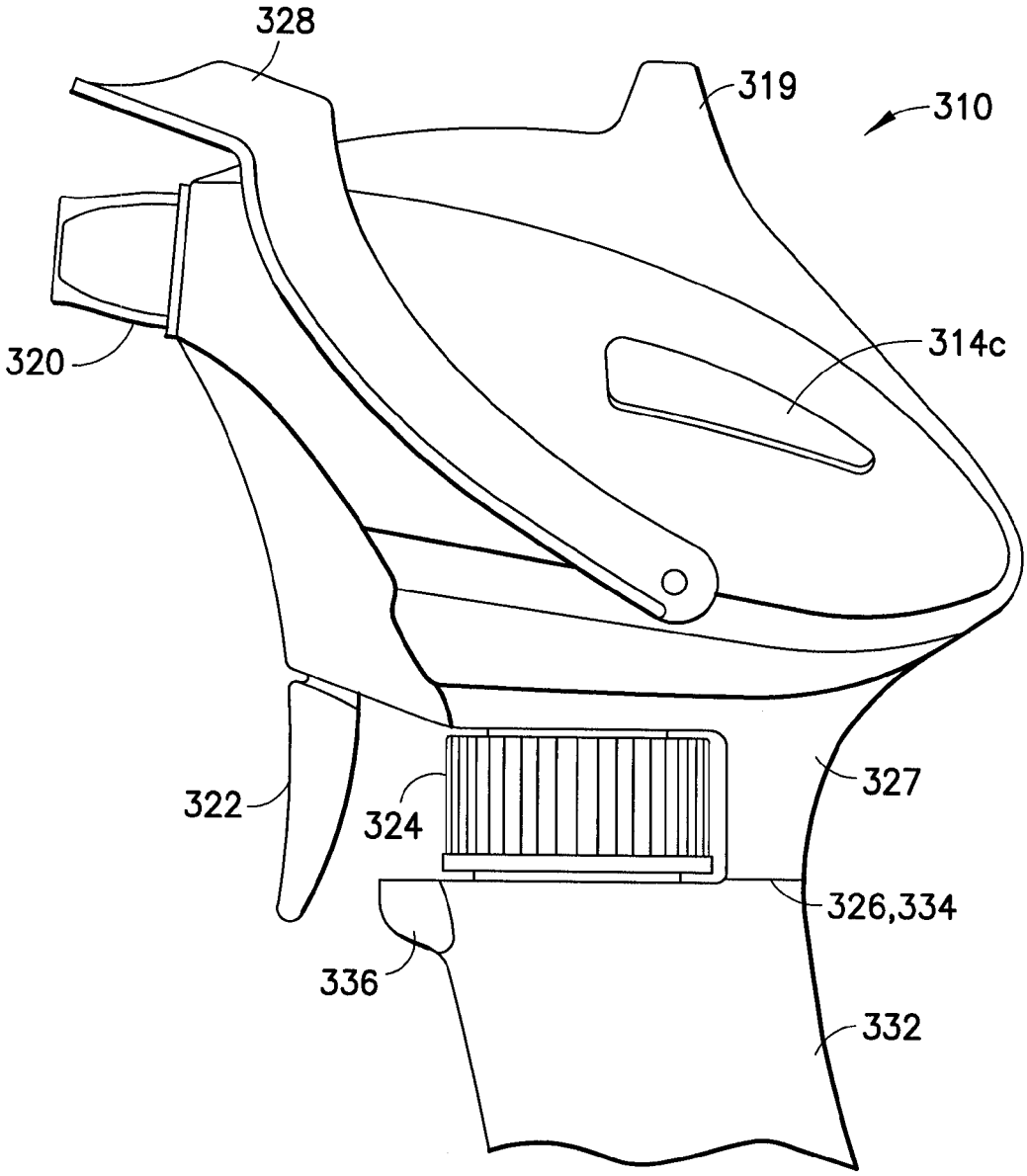
FIG. 14 is a broken side elevation view of a fourth embodiment of a sprayer according to the invention.

FIG. 14 illustrates a fourth embodiment of a sprayer 310 according to the invention which is similar to the first embodiment with similar reference numerals (increased by 300) referring to similar features. The main difference in this embodiment is that the load bearing surface 334 of the bottle 332 is a planar surface behind the coupling 324 and the planar surface 326 on the sprayer is at the bottom of a downward depending extension 327. The extension 327 has a generally semi-circular cross section and a thickness sufficient to withstand the vertical component of force exerted on it when the lever 328 is pulled backward to charge the pump.

Figure 15:
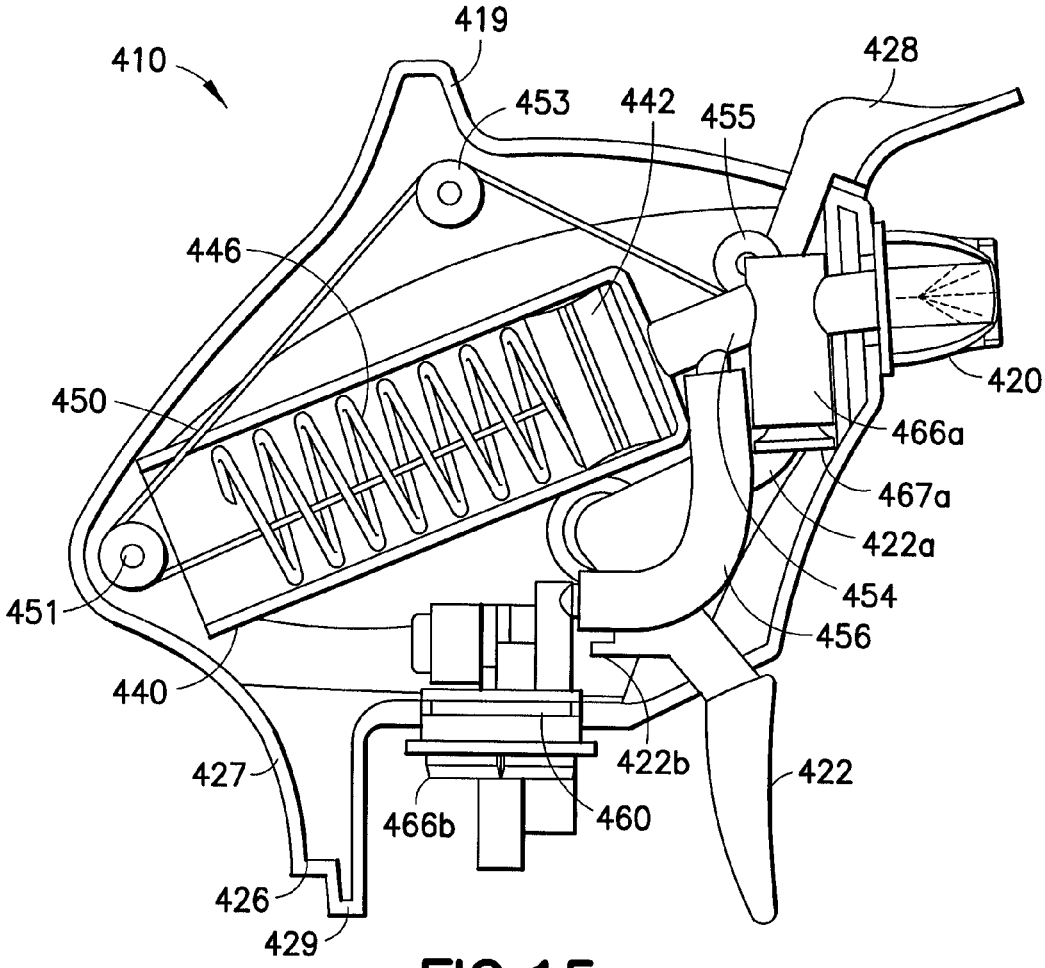
FIG. 15 is a partially disassembled broken side elevation view of a fifth embodiment of a sprayer according to the invention.
Figure 16:
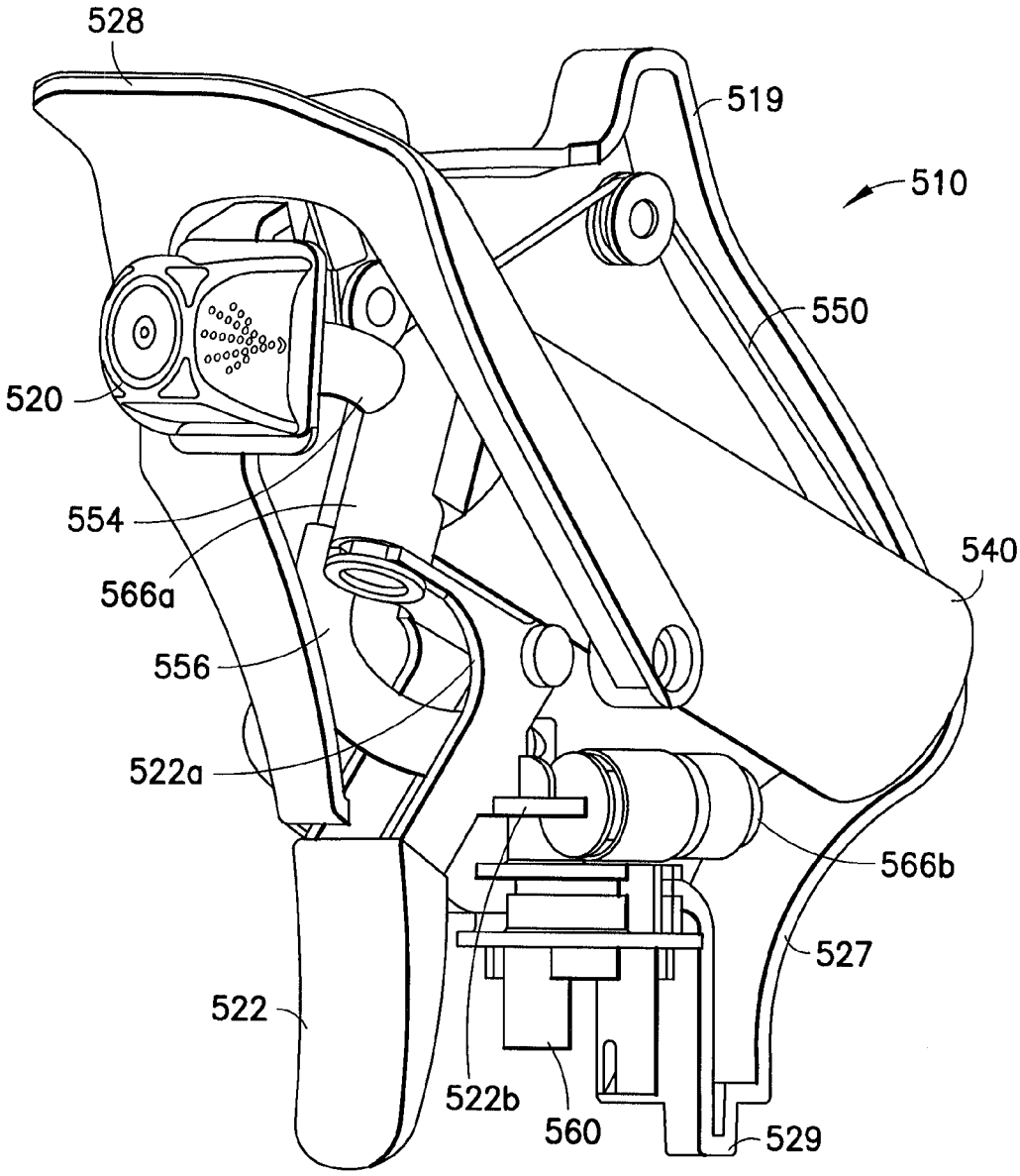
FIG. 16 is a partially disassembled perspective view of a sixth embodiment of a sprayer according to the invention.

FIGS. 15 and 16 show fifth and sixth embodiments, respectively. These embodiments are, in many ways, similar to the first embodiment with similar reference numerals (increased by 400 and 500, respectively) referring to similar features. The main difference in these embodiments is that the accumulator 440, 540 is arranged with its inlet and outlet adjacent to the nozzle 420, 520.

Referring now to FIG. 15, the sprayer 410 includes a nozzle 420, a trigger 422, a downward depending extension 427 terminating with a load bearing surface 426 and an interlock 429. A charging lever 428 and a thumb support 419 are located on the top of the sprayer. An accumulator 440 is located inside the sprayer. The accumulator includes a piston 442 and a spring 446. A flexible cable 450 is coupled at one end to the piston 442 and at the other end to the charging lever 428. A plurality of pulleys 451, 453, 455 guide the cable 450 from the back of the accumulator to the front. An inlet and outlet manifold 454 is located between the accumulator 440 and the nozzle 420. Inlet hose 456 couples the manifold 454 with inlet check valve 460. An outlet valve 466*a* having a piston 467*a* is coupled between the manifold 454 and the nozzle 420. An air relief valve 466*b* having a piston (not shown) is provided adjacent to the inlet check valve 460. An upper arm 422*a* of the trigger 422 engages the piston 467*a* of the outlet valve 466*a* and a lower arm 422*b* of the trigger engages the piston of the air relief valve 466*b*. The sprayer is operated in the same manner as the sprayers described above. The lever 428 is pulled back to charge the accumulator and the trigger 422 is pulled to dispense fluid through the nozzle 420. Actuation of the trigger 422 causes the upper arm 422*a* to move downward thereby pulling the piston 467*a* downward and opening the outlet valve 466*a* allowing liquid to flow from the accumulator through the nozzle 420. Simultaneously, the lower arm 422*b* moves backward engaging the piston of the air relief valve 466*b* allowing a volume of air equivalent to the volume of liquid in the accumulator to enter the bottle (not shown).

FIG. 16 shows a sprayer 510 which is similar to the sprayer 410 with similar reference numerals (increased by 100) referring to similar features. The difference between the sprayer 510 and the sprayer 410 is that the outlet valve 566*a* is coupled directly to the accumulator 540 and the inlet hose 556 enters the manifold 554 along side the valve 566*a* rather than behind it as shown in FIG. 15.

FIGS. 17 through 24 show a seventh embodiment of a sprayer 610 and bottle 612. This embodiment is similar to the fifth and sixth embodiments and similar elements will be referred to with similar reference numerals (increased by 200 and 100 respectively). The sprayer 610 generally includes an ellipsoidal body having left and right half shells 614, 616. Each half shell has an upper vane 614*a*, 616*a* and a lower wing 614*b*, 616*b*. At least one of the half shells, e.g. 616 has a side window 616*c* as seen best in FIGS. 21 and 22. The two vanes 614*a*, 616*a* join to define a groove 618 which extends from the front of the body to a point short of the rear as seen best in FIGS. 21 and 22. The front of the body is provided with an adjustable nozzle 620 and the bottom of the body is provided with a trigger 622, a bottle coupling 624, and a load bearing surface 626. A pull lever 628 is mounted above the wings 614*b*, 616*b*. The lever 628 is a generally inverted U-shape having two legs 628*a*, 628*b* and a cross member 628*c*. The cross member 628*c* defines an upwardly extending handle 628*d* and a downwardly extending rudder (not shown) which engages and rides in the groove 618. The ends of the legs 628*a*, 628*b* have holes 628*f*, 628*g* (FIG. 18) which are engaged by screws 629*a*, 629*b*. These screws engage holes 614*d*, 616*d* in the left and right half shells 614, 616 and define the pivot axis of the lever 628. The pivot axis is preferably aligned close to or on the vertical axis of the bottle coupling 624.

Figure 17:
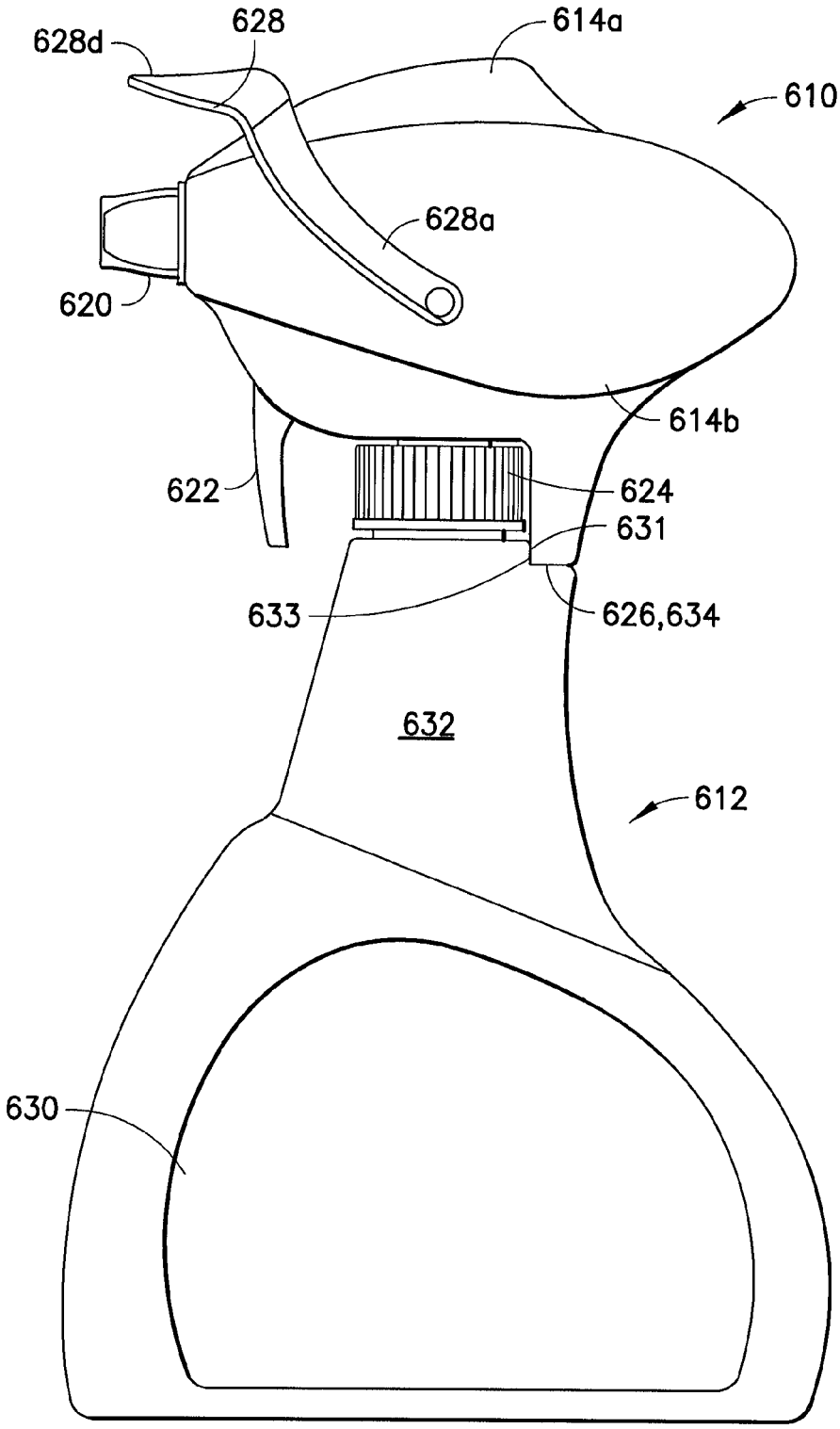
FIG. 17 is a side elevation view of a seventh embodiment of a sprayer according to the invention attached to a bottle according to the invention.

As seen best in FIG. 17, the bottle 612 has a lower tank area 630 and an upper neck 632 which is dimensioned to be grasped by an adult human hand. The neck 632 has a threaded coupling which is hidden under the coupling 624 of the sprayer 610. Behind the coupling the bottle has a load bearing surface 634 which abuts the load bearing surface 626 on the sprayer 610. As illustrated, the load bearing surface 634 is a plateau on the neck 632 stepped down from the threaded coupling. As seen best in FIGS. 17, 21, and 22 the load bearing surface 634 is adjacent a vertical planar surface 633 which engages a similar surface 631 on the sprayer 610 which together form an anti-rotation structure.

Figure 18:
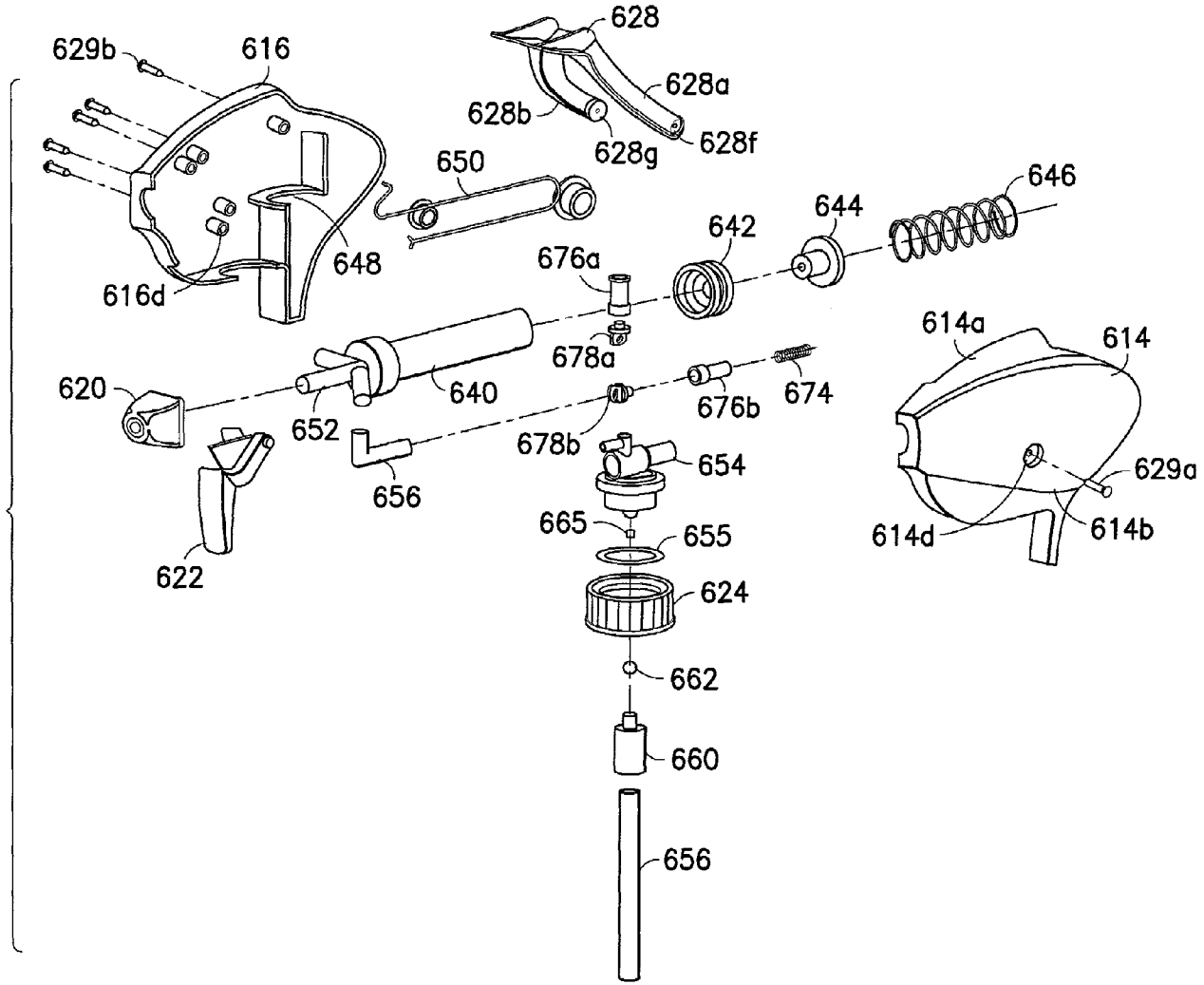
FIG. 18 is an exploded view of the sprayer of FIG. 17.
Figure 19:
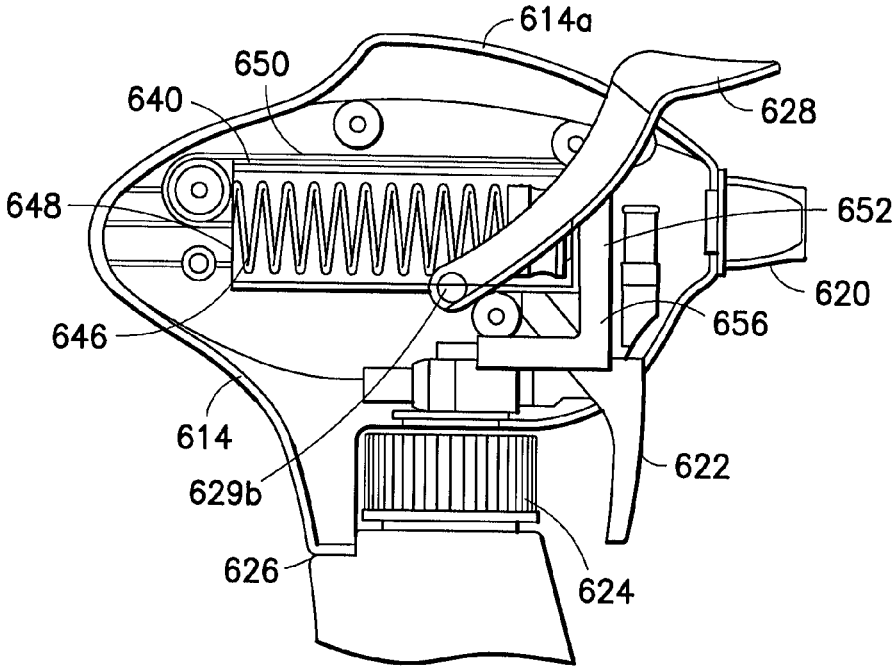
FIG. 19 is a partially disassembled broken side elevation view of the right side of the sprayer and bottle of FIG. 17.
Figure 20:
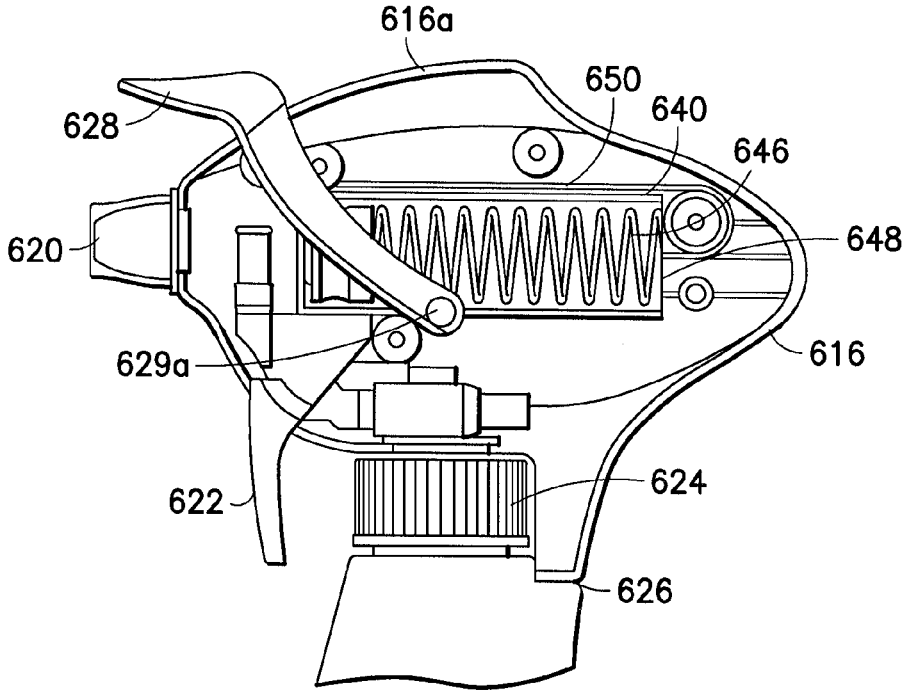
FIG. 20 is a partially disassembled broken side elevation view of the left side of the sprayer and bottle of FIG. 17.
Figure 21:
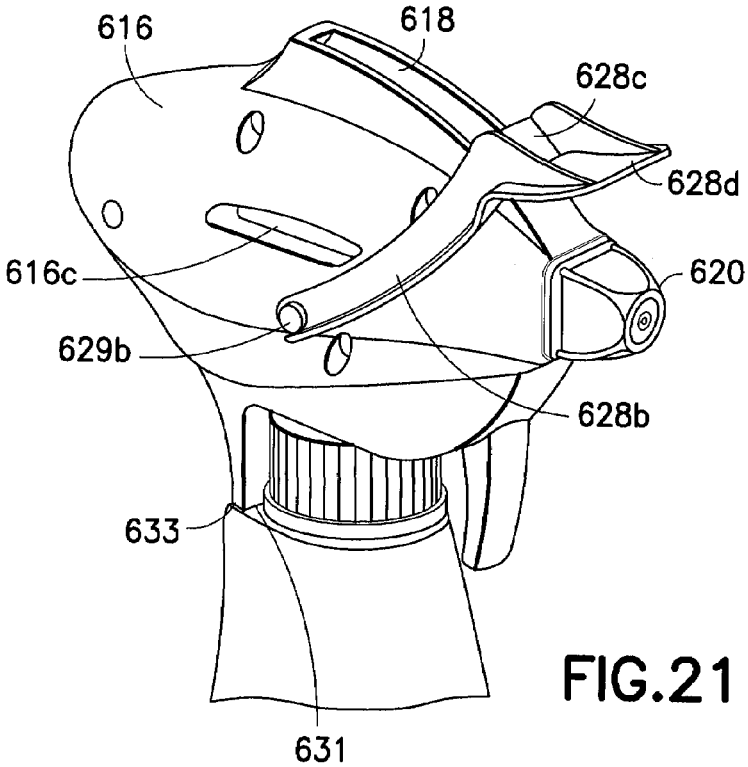
FIG. 21 is a broken perspective view of the front of the sprayer and bottle of FIG. 17.
Figure 22:
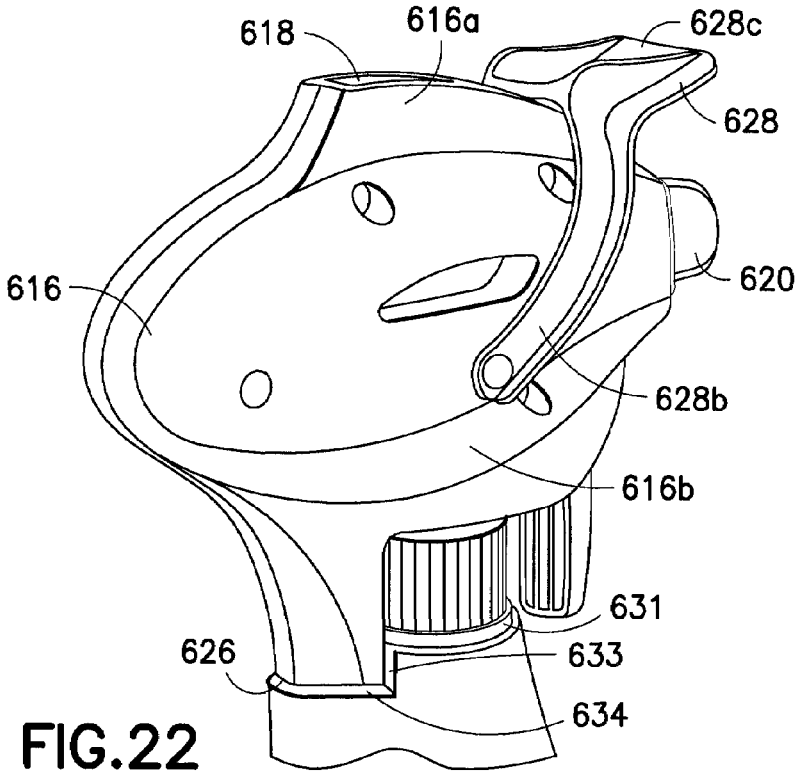
FIG. 22 is a broken perspective view of the rear of the sprayer and bottle of FIG. 17.
Figure 23:
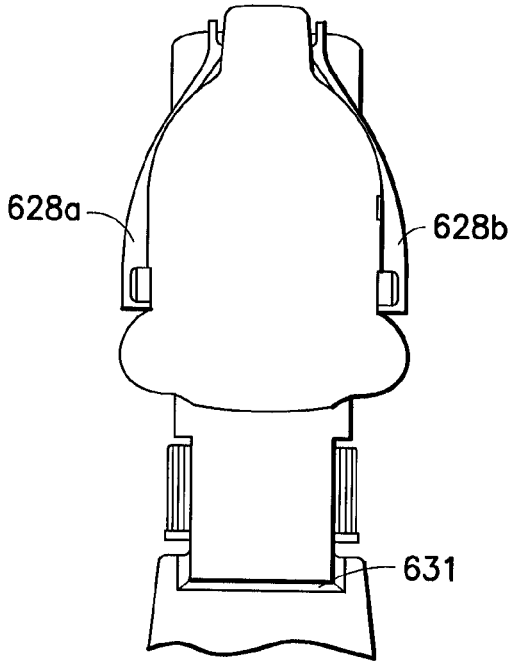
FIG. 23 is a broken rear elevation view of the sprayer and bottle of FIG. 17.
Figure 24:
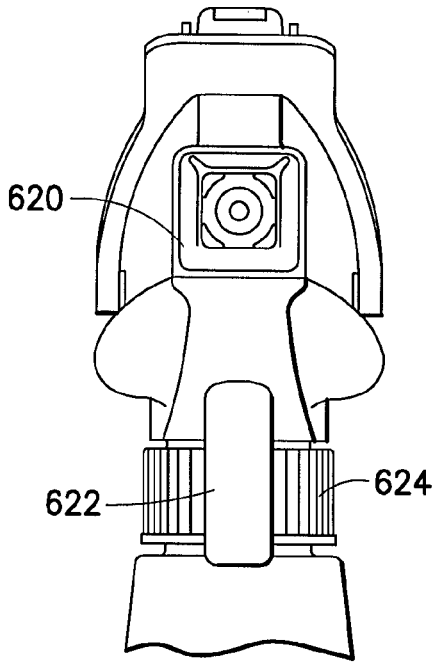
FIG. 24 is a broken front elevation view of the sprayer and bottle of FIG. 17.

Turning now to FIGS. 18-20, the inner workings of the sprayer 610 are shown in detail. The sprayer includes an accumulator 640 (a piston cylinder), a piston 642, a piston retainer 644, a biasing spring 646, and a pull cable 650. The half shells 614, 616, when assembled, form a slotted retainer wall 648 which abuts the spring 646. These components are assembled by extending the pull cable 650 through the slotted retainer wall 648 and the spring 646 to the retainer 644. One end of the cable 650 is attached to the retainer 644 which is coupled to the piston 642. The piston 642 is inserted into the accumulator 640 with the retainer 644 and the cable 650 following it. The spring 646 is inserted into the accumulator 640 behind the retainer 644 and the accumulator is closed by the slotted retainer wall 648. The free end of the cable 650 extends through the slot in the wall 648 and is attached to the pull lever 628. At the forward end of the accumulator 640 is a fluid inlet/outlet 652 to which a manifold 654 is attached via an elbow 656. The manifold 654 is coupled to the bottle coupling 624 with a gasket 655. An inlet tube 656 is coupled to the manifold 654 via a ball check valve assembly 660, 662.

Two valves are provided: one in the fluid outlet 652 and the other in the manifold 654 which acts as an air inlet for the bottle 612. The outlet valve includes a piston 676*a* and a piston adapter 678*a*. The piston is mounted in a cylinder in the fluid outlet 652 and is coupled to the adapter 678*a* which is coupled to the trigger 622. The air inlet valve includes a spring 674, a piston 676*b*, and an adapter 678*b*. The spring and the piston are mounted in a cylinder in the manifold 654 and the piston is coupled to the adapter 678*b* which is coupled to the trigger 622. The spring 674 biases the valves shut and the trigger forward. When the trigger is pulled backward, both valves open allowing fluid to escape from the accumulator 640 through the nozzle 620 and allowing air to enter the bottle 612. A second check valve ball 665 is mounted in the manifold and operates when the sprayer and bottle are inverted while operating to prevent leakage through the vent.

There have been described and illustrated herein several embodiments of a sustained duration non-aerosol mechanical sprayer. While particular embodiments of the invention have been described, it is not intended that the invention be limited thereto, as it is intended that the invention be as broad in scope as the art will allow and that the specification be read likewise. It will therefore be appreciated by those skilled in the art that modifications could be made to the provided invention without deviating from its spirit and scope as claimed.

What is claimed is:

1. A sustained duration non-aerosol mechanical sprayer for use with a bottle, said sprayer comprising:
- a spray head;
- a clear or translucent fluid cylinder mounted inside the spray head;
- a charging apparatus coupled to said spray head and movable from a first charging apparatus position to a second charging apparatus position to draw fluid into said fluid cylinder from the bottle without first discharging fluid from said fluid cylinder; and
- a dispensing trigger coupled to said spray head and being movable from a first dispensing trigger position to a second dispensing trigger position to permit fluid to exit said fluid cylinder in a sustained duration manner without drawing fluid into said fluid cylinder when said trigger is returned to the first dispensing trigger position, wherein
- the spray head has a first window through which the contents of the fluid cylinder are visible.

2. A sprayer according to claim 1, wherein:
- said spray head has a coupling for connecting it to the bottle, said coupling defining a vertical axis, and
- said fluid cylinder has an axis which transects the vertical axis.

3. A sprayer according to claim 2, wherein:
- said first window is substantially parallel to the axis of said fluid cylinder.

4. A sprayer according to claim 1, wherein:
- the spray head has a second window through which the contents of the fluid cylinder are visible, the first window being on one side of the spray head and the second window being on another side of the spray head.

5. A sustained duration non-aerosol mechanical sprayer assembly, comprising:
- a bottle;
- a spray head coupled to said bottle;
- a clear or translucent fluid cylinder mounted inside the spray head;
- a charging apparatus coupled to said spray head and movable from a first charging apparatus position to a second charging apparatus position to draw fluid into said fluid cylinder from the bottle without first discharging fluid from said fluid cylinder; and
- a dispensing trigger coupled to said spray head and being movable from a first dispensing trigger position to a second dispensing trigger position to permit fluid to exit said fluid cylinder in a sustained duration manner without drawing fluid into said fluid cylinder when said trigger is returned to the first dispensing trigger position, wherein the spray head has a first window through which the contents of the fluid cylinder are visible.

6. A sprayer assembly according to claim 5, wherein:

said spray head is coupled to the bottle by a coupling, said coupling defining a vertical axis, and said fluid cylinder has an axis which transects the vertical axis.

7. A sprayer assembly according to claim 6, wherein:

said first window is substantially parallel to the axis of said fluid cylinder.

8. A sprayer assembly according to claim 5, wherein:

the spray head has a second window through which the contents of the fluid cylinder are visible, the first window being on one side of the spray head and the second window being on another side of the spray head.

* * * * *